United States Patent [19]

Braun et al.

[11] 4,265,083

[45] May 5, 1981

[54] PROCESS AND APPARATUS FOR INDIVIDUAL PIECING UP OF SINGLE OPEN END SPINNING APPARATUS

[75] Inventors: Erwin Braun; Erich Bock, both of Ingolstadt; Karl Handschuch, Lippertshofen; Edmund Schuller, Ingolstadt, all of Fed. Rep. of Germany

[73] Assignee: Schubert & Salzer, Ingolstadt, Fed. Rep. of Germany

[21] Appl. No.: 20,210

[22] Filed: Mar. 13, 1979

[30] Foreign Application Priority Data

Mar. 18, 1978 [DE] Fed. Rep. of Germany ..... 2811960

[51] Int. Cl.[3] ..... D01H 7/885; D01H 15/00

[52] U.S. Cl. ..... 57/263; 57/88; 57/302; 57/304

[58] Field of Search ..... 57/261, 263, 88, 89, 57/301, 302, 304, 58.89–58.95

[56] References Cited

U.S. PATENT DOCUMENTS

| | | | |
|---|---|---|---|
| 3,597,911 | 8/1971 | Schiltknecht | 57/302 |
| 3,760,577 | 9/1973 | Kihara et al. | 57/302 |
| 3,859,779 | 1/1975 | Furstenberg | 57/302 X |
| 3,895,483 | 7/1975 | Grau | 57/58.89 X |
| 4,038,812 | 8/1977 | Stahlecker | 57/58.95 X |
| 4,057,955 | 11/1977 | Roehrich | 57/302 |
| 4,058,963 | 11/1977 | Stahlecker | 57/302 |
| 4,069,654 | 1/1978 | Roehrich | 57/302 |
| 4,109,451 | 8/1978 | Yamada et al. | 57/302 |
| 4,166,356 | 9/1979 | Chrtek et al. | 57/302 |

*Primary Examiner*—John Petrakes

*Attorney, Agent, or Firm*—Bailey, Dority & Flint

[57] ABSTRACT

A method and apparatus for individually piecing up yarn on an open-end spinning machine which has a spinning rotor and a rotor brake. A rotor cleaning apparatus is carried on a pivotal cover and is used for cleaning the rotor responsive to being activated. A pivotal lever which when moved relative to the cover simultaneously activates the rotor cleaning apparatus and the rotor brake causing the rotor to be cleaned as the rotor is being stopped. The yarn is pieced up when the rotor is being brought back up to running speed.

20 Claims, 4 Drawing Figures

PROCESS AND APPARATUS FOR INDIVIDUAL PIECING UP OF SINGLE OPEN END SPINNING APPARATUS

BACKGROUND OF THE INVENTION

The present invention relates to the process for individual piecing-up of single open-end spinning apparatus while a spinning rotor is running at reduced speed, in which the piecing process is preceded by a cleaning of the rotor with pneumatic removal of the dislodged trash components, and also to an apparatus for carrying out this process.

A yarn break nearly always occurs in conjunction with contamination of the rotor. Either the yarn break is a result of the rotor contamination, or else contamination of the rotor arises from the yarn break, from fiber material remaining in the rotor and from the broken-off remainder of the yarn. It is therefore necessary as a rule to first make the rotor suitable for spinning again. But for this purpose cleaning of the rotor is required.

For this purpose it is known to cause a cleaning apparatus to travel to the spinning position at which the spinning rotor is to be cleaned (West German Offenlegungsschrift No. 2,410,269). With the aid of a first drive, a guide head is brought near the spinning position and aligned with the yarn takeoff channel. A second drive introduces a flexible probe through the guide head and the yarn takeoff channel into the spinning rotor. A third apparatus in addition switches on a stream of compressed air in order to support the introduction of the probe into the spinning rotor. By means of a fourth drive, finally, the rotor brake is actuated interbriefly and possibly intermittently. After the cleaning process, the probe is removed from the spinning rotor by retracting it, on which compressed air is blown into the spinning rotor again or with increased force. Simultaneously, the rotation speed of the spinning rotor is again briefly reduced. Such an apparatus is very expensive, since for the many control processes it makes many control and drive equipments necessary.

It is furthermore known that the rotor brake can be actuated both with the cover closed, during yarn break elimination, and also on opening the cover (West German Auslegeschrift No. 2,109,975). This apparatus, however, only constitutes a solution for the rotor brake. The control of rotor cleaning is here left untouched, and is carried out in the hitherto known manner.

Since the control of rotor cleaning is extremely complicated, it was hitherto always necessary to undertake rotor cleaning and piecing after the completion of cleaning by separate apparatuses (West German Offenlegungsschrift No. 2,528,009). These apparatuses are hence very expensive.

For the subsequent piecing it is of great importance that the spinning rotor to be satisfactorily cleaned, as otherwise the piecing process will be ineffective. If, however, cleaning of the rotor is carried out by hand, it is completely dependent on the care and dexterity of the operator.

SUMMARY OF THE INVENTION

The purpose of the present invention is thus to produce a simple process and a simple apparatus, with the aid of which cleaning of the spinning rotor is effected independently of the care taken by the operator, as a precondition for a successful and rapid elimination of individual yarn breaks.

This task is solved according to the invention in that the spinning rotor is halted before the piecing process and is cleaned during the process of halting, until the rotor has come to rest, and that the piecing process is carried out during the acceleration of the spinning rotor to working speed. Since the cleaning is carried out while the rotor is being stopped, until it has come to rest, it is insured that the cleaning agent first releases the adherent trash particles while the spinning rotor is still revolving, over the whole inner periphery of the spinning rotor, and these particles are then pneumatically carried away while the centrifugal force is diminished or absent. In this way it is insured that the trash is, on the one hand, satisfactorily released from the spinning rotor, and on the other hand is with certainty carried away. There is thus obtained in a simple manner the necessary precondition for a reliable piecing. By using the stopping process for rotor cleaning and the acceleration to working speed again for piecing, these work processes are carried out in an economical manner.

For carrying out this process, the rotor cleaning apparatus is arranged, according to the invention, on a cover which covers the spinning rotor and is pivotable relative to it, and there is associated with the rotor brake apparatus and the rotor cleaning apparatus a common control lever, which is movable with the cover for actuation of the rotor brake apparatus and relative to the cover for actuation of the rotor cleaning apparatus and the rotor brake apparatus. Hence, cleaning is possible with the spinning rotor covered and independently of the operator, and indeed by means of a single actuating movement. The control lever also establishes the sequence of cleaning being effected when the spinning rotor is braked but has not yet come to rest. On the other hand it is simultaneously satisfactorily insured that the spinning rotor, when released, is automatically stopped, but however without the rotor cleaning apparatus coming into action.

The control lever can advantageously assume three working positions relative to the cover, being locked to the cover in the first position, releasing the spinning rotor by means of the rotor brake apparatus and keeping the rotor cleaning apparatus inoperative; in the second position, allowing the rotor brake and the rotor cleaning apparatuses to act on the spinning rotor; and, in the intermediately positioned third position, allowing the rotor brake apparatus to act on the spinning rotor, but keeping the rotor cleaning apparatus inoperative. In this way, a piecing can be carried out particularly easily in the acceleration phase of the spinning rotor, since a clear separation between rotor cleaning and starting of the spinning rotor is effected.

According to a preferred embodiment of the invention, the rotor cleaning apparatus has a compressed air nozzle directed against the interior of the spinning rotor and a switch element for the compressed air nozzle, this element being arranged on the cover and actuatable by the control lever. In this way, the compressed air nozzle and thus the rotor cleaning apparatus are only released when the control lever is moved relative to the closed cover. If, however, the control lever is moved by opening the cover, the compressed air nozzle is not released; the rotor cleaning apparatus does not operate.

The control lever is advantageously connected via a pull element with the switch element, the pull element being connected to the control lever outside the pivot axis of the latter. In this way a more exact synchronization can be obtained between the working path of the control lever and thus the braking of the spinning rotor, on the one hand, and the carrying out of rotor cleaning, on the other hand.

To avoid projecting parts, and hence a source of possible injuries, the control lever, in the preferred embodiment of the invention, terminates flush with the outer surface of this cover when locked to the latter. The connection and locking action between the control lever and cover can be carried out in various ways, for example, in the form of a ball latch which, by corresponding application of a force to the control lever, releases the latter. Preferably, however, the cover has a handle and an actuating element immediately adjacent to it, for cancelling the lock between the control lever and the cover; in a further embodiment of the invention, the control lever is acted on by an elastic energy accumulator such as a spring which brings the control lever from its first position to its second position when the locking between the control lever and the cover is cancelled. According to a particularly simple embodiment of the invention, the elastic energy accumulator is associated with the rotor brake apparatus and acts via this on the control lever.

Accordingly, it is an important object of the present invention to provide a method and apparatus for cleaning the rotor of an open-end spinning machine while the rotor is being brought to rest prior to piecing up the yarn.

Still another important object of the present invention is to provide a very efficient method and apparatus for cleaning the rotor and piecing up yarn on an open-end spinning device.

Still another important object of the present invention is to provide a method and apparatus of piecing up yarn on an open-end spinning device and cleaning the rotor associated therewith, responsive to manipulating a lever associated with the cover of the open-end spinning device.

These and other objects and advantages of the invention will become apparent upon reference to the following specification, attendant claims and drawings.

DESCRIPTION OF A PREFERRED EMBODIMENT

Figure 1:
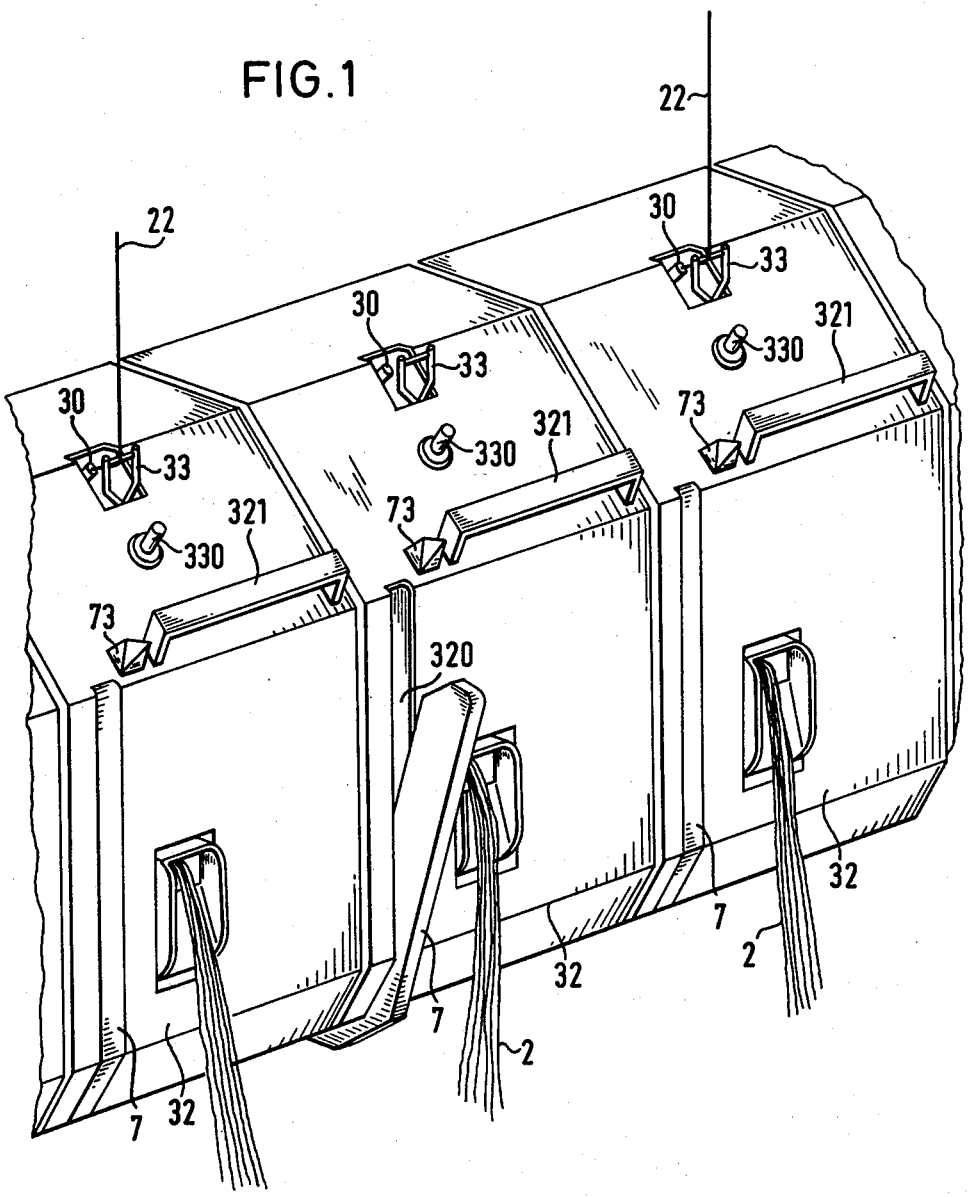
FIG. 1 is a perspective view of a spinning apparatus constructed in accordance with the invention.
Figure 2:
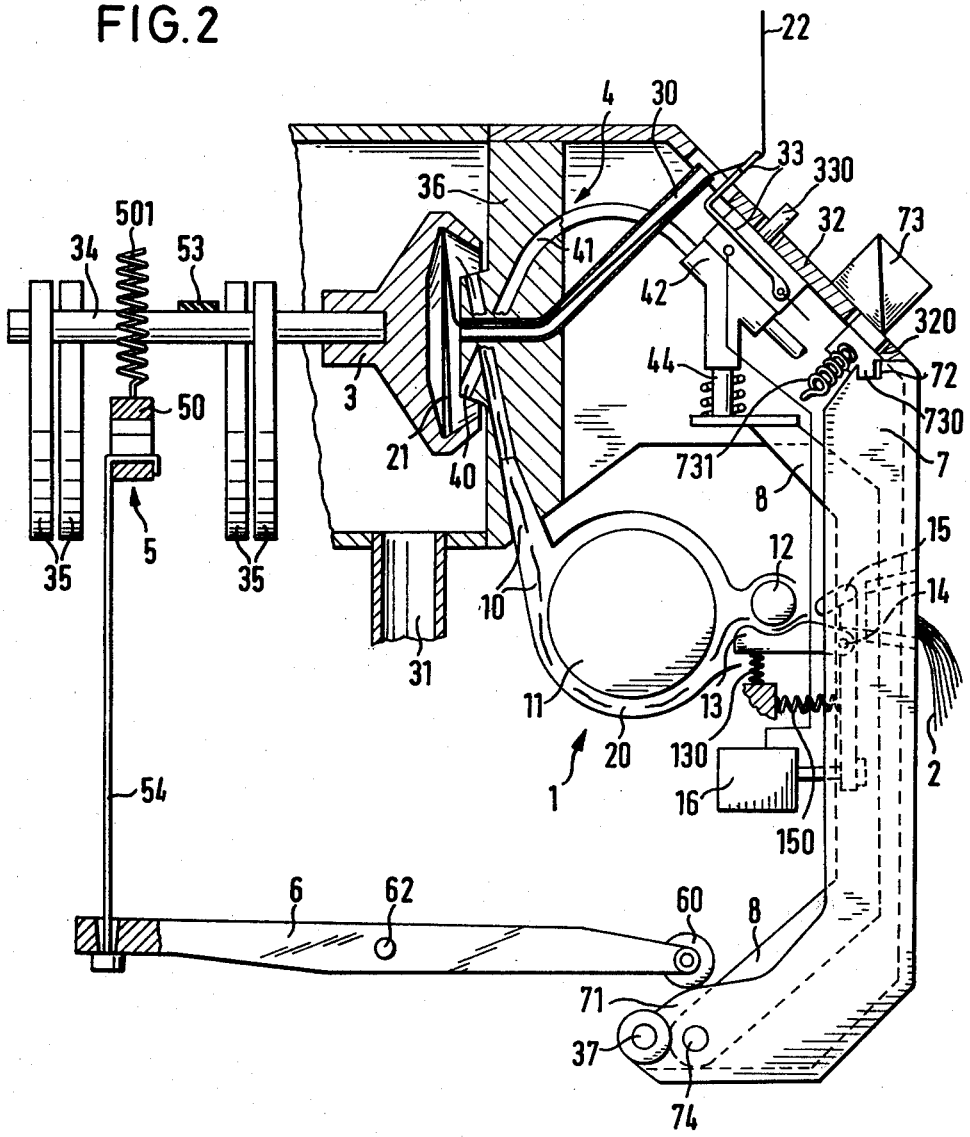
FIG. 2 is a side view of the apparatus shown in FIG. 1, in partial section.

An open-end spinning apparatus constructed according to the invention is shown in FIGS. 1 and 2. A roving 2, loosened into individual fibers 20, is conventionally fed by means of a feeding and opening apparatus 1 via a fiber feed channel 10 into the interior of a spinning rotor 3, where the individual fibers 20 arrive in a collecting groove and are formed into a ring of fibers 21. The fiber ring 21 is conventionally bound into the end of a yarn 22, which is drawn off via a yarn takeoff tube 30 by a pair of takeoff rollers (not shown) and conventionally wound up onto a bobbin (not shown).

The reduced pressure required in the spinning rotor 3 for spinning is conventionally produced by a source (not shown) of reduced pressure via an air suction connection 31.

The feed and opening apparatus 1 can be designed in any given way, for example as a drafting zone. In the embodiment shown, however, an opening roller 11 is utilized, to which the roving 2 is fed by means of a supply roller 12 and an associated feed trough 13. The feed trough 13 is pressed by a pressure spring 130 against the supply roller 12. A clamping lever 15, at the same time constructed as a feed hopper, is mounted on the pivot axis of the feed trough 13, and is lifted by an electromagnet 16 from the feed trough 13, thus releasing the roving 2. If, however, the electromagnet 16 releases the clamping lever 15 by the action on it of a compression spring 150, the feed trough 13 is lifted from the supply roller 12 and the roving 2 is held fast between the feed trough 13 and the clamping lever 15.

A yarn monitor 33 is arranged at the outlet of the yarn takeoff tube 30, and can also be mechanically actuated by means of a switch button 330. The switch button 330 extends through a cover 32, which covers the feed and opening apparatus 1 and the spinning rotor 3, which is located in a housing (not shown). The cover 32 carries the yarn takeoff tube 30, the yarn monitor 33, and a part of the fiber feed channel 10. The yarn monitor 33 is connected in the usual way with the electromagnet 16, to interrupt the fiber feed into the spinning rotor 3.

A rotor cleaning apparatus 4 is located on the cover 32. In the embodiment shown, this rotor cleaning apparatus 4 has a compressed air nozzle 40, which is directed against the inner wall of the spinning rotor 3. If desired, several compressed air nozzles can also be provided, directed at various places and at different angles against the inner wall of the spinning rotor 3. In the embodiment shown, the compressed air nozzle is directed against the collecting groove, in which the fiber ring 21 forms during the spinning processes. Compressed air is fed to the compressed air nozzle(s) via a feed duct 31 in which a valve 42 is fitted.

Figure 4:
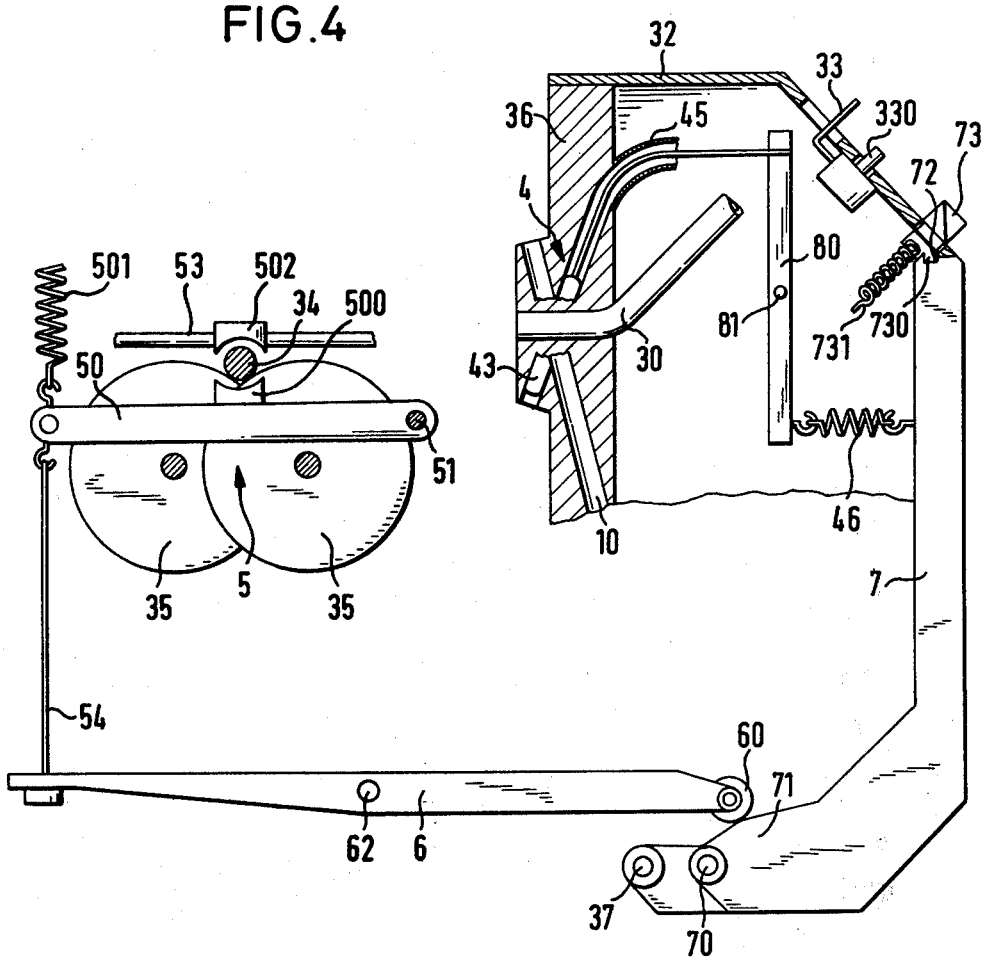
FIG. 4 is a further modified form of the spinning apparatus constructed according to the invention utilizing mechanical rotor cleaning apparatus, in side view and in partial section.

As shown in FIGS. 2 and 4, the spinning rotor 3 is conventionally mounted with its shaft 34 in a "V" formed by the intersection of the support rollers 35. A rotor brake apparatus 5 can be brought into engagement with the shaft 34. This rotor brake apparatus 5 has a brake lever 50 with a brake block 500 which is acted on by a tension spring 501. The brake block 500 is mounted at one end to pivot about a pivot axis 51, while at its other end it carries a roller 52 by means of which the drive belt 53 can be lifted from the shaft 34 of the spinning rotor 3. A pull element 54 is connected with the end of the brake lever 50 carrying the roller 52, and the other end of this element is guided to, and connected with, a transmission lever 6.

The transmission lever 6 can pivot about a shaft 62 and has at its free end a roller 60 which bears on a switch cam 71. This switch cam 71 is an integral part of a control lever 7, which is fitted in a slot 320 of the cover 32 and is carried, in common with the cover 32, on a pivot axis 37. The control lever 7 is acted on via the transmission lever 6 and the brake lever 50 by the compression spring 501 mentioned above. At its end remote from the pivot axis 37 it has a recess 72, into which engages a latch lug 730 of a release button 73, the lug being movable transversely of the pivoting motion of the control lever 7 and held in its locking position by a tension spring 731.

Near the pivot axis 37, there is provided on the control lever 7 a hinge axis 74 via which it is connected to a pull element 8 that engages an actuating pin 44 of the valve 42.

FIG. 2 shows the spinning apparatus during normal spinning operation. Since the yarn 22, when wound up by the bobbin (not shown), is tensioned and actuates the yarn monitor 33, the electromagnet 16 also releases the roving 2 via the clamping lever 15, so that the fiber material is fed to the spinning rotor 3 with the aid of the feed and opening apparatus 1 and in the spinning rotor 3 becomes bound into the end of the yarn 22. If now a yarn break occurs, this is registered by the yarn monitor 33, and the fiber feed into the spinning rotor 3 is shut off by the electromagnet 16.

When the operator discovers the fault, which can be indicated by an alarm unit, e.g., a signal lamp (not shown) associated with the yarn monitor 33, she raises the bobbin arm (not shown) and places it in the inoperative position, so that windup is discontinued.

In order to prepare the spinning apparatus for piecing-up, the spinning rotor 3 must be cleaned. For this purpose, the operator grips the cover 32 by the handle 321 and with her thumb pulls the release button 73 against the handle 321. The latch lug 730 then releases the control lever 7. Under the action of the tension spring 501, which acts via the brake lever 50, the pull element 54 and the transmission lever 6 and also the switch cam 71 on the control lever 7, the control lever 7 is snapped out of the slot 320 of the cover 32.

The brake lever 50, pivoted under the action of the tension spring 501, now abuts with its brake block 500 on the shaft 34 of the spinning rotor 3, while the roller 52 raises the drive belt 53 from the shaft 34. Simultaneously the shaft 34 is lifted out of the "V" of the support disks 35 and is pressed onto a stationary brake block 502 (FIG. 4). The spinning rotor 3 is thus stopped. During this process of stopping the spinning rotor 3, the valve 42 is actuated by the control lever 7 via the pull element 8, and permits supply of compressed air into the spinning rotor 3. The spinning rotor is thus cleaned while the speed of the spinning rotor 3 is reduced to a standstill. The source of reduced pressure (not shown) that produces the reduced pressure required for spinning, remains operative and carries away the detached trash particles via the open end of the spinning rotor and through the air suction connection 31.

For piecing up again, the operator grasps the yarn end on the bobbin (not shown), pulls from this a sufficiently long piece of yarn, and brings the yarn 22 to the exact length for piecing by parting the yarn end which the yarn break has caused. The operator now pushes the control lever 7 again into the slot 320 in the cover 32, where the latch lug 730 latches in the recess 72 of the control lever 7. As a result, the pull element 8 also returns into its upper inoperative position and releases the valve 42, which now closes again and interrupts the supply of compressed air into the spinning rotor 3. The cleaning of the rotor is thereby completed.

In addition, the transmission lever 6, and hence also the rotor braking apparatus 5, is pivoted by means of the switch cam 71 against the action of the tension spring 501. The shaft 34 of the spinning rotor 3 accordingly moves away from the brake block 502 and is seated in the "V" of the support disks 35. At the same time the roller 52 carried by the brake lever 50 releases the drive belt 53, and this now again abuts the shaft 34 of the spinning rotor 3 and drives it.

The operator now inserts the yarn 22 into the yarn takeoff tube 30, where the yarn 22 is sucked in by the reduced pressure acting in the spinning rotor 3, and lowers the bobbin arm (not shown). Simultaneously she actuates the switch button 330, so that the clamping lever 15 releases the roving 2 and separate fibers 20 which again arrive in the spinning rotor 3, in which they are deposited in the form of a fiber ring 21. Before the spinning rotor 3 has been accelerated again up to production speed as a result of the resumed drive connection, the yarn 22 comes into contact with the fiber ring 21, so that the latter is bound into the end of the yarn 22. Piecing of the yarn thus takes place at reduced rotor speed of revolution. The renewed yarn tension due to the windup which is now resumed causes the yarn 22 to be threaded, in known manner, into the takeoff roller pair 31 and to be continuously withdrawn. The switch button 330 is now released.

Thus, with a single operation, braking of the spinning rotor 3 and then initiation of rotor cleaning are effected. Likewise with a single operation, after the rotor cleaning apparatus 4 has been turned off, the rotor brake apparatus 5 is disconnected and hence the spinning rotor 3 is released. Since at any given time only a single movement function is necessary for stopping and cleaning the spinning rotor, on the one hand, and for ending of cleaning and also release of the spinning rotor 3 on the other hand, a very simple automatic drive is also possible instead of hand operation.

In spite of this simple control movement for the rotor brake apparatus 5 and the rotor cleaning apparatus 4, both these apparatuses can be controlled in precisely the sequence which suits requirements. Thus, cleaning first begins when initialing the braking of the spinning rotor, and remains in action until the spinning rotor 3 has come to rest, so that the detached trash components are pneumatically carried away with certainty. For piecing, the rotor cleaning apparatus 4 is first shut off, so that this is no longer active and hence does not impair the piecing process.

If the cover 32 has to be opened for maintenance, rendering the spinning rotor 3 accessible, the cover 32 is grasped by the handle 321 and pulled forward, so that it pivots about its pivot axis 37. A relative motion between the control lever 7 and the cover 32 does not occur, so that the pull element 8 is also not actuated. Hence, release of the rotor cleaning apparatus 4 also does not occur. Thus, cleaning of the spinning rotor 3 is omitted.

Since the control lever 32 remains locked to the cover 32, this also takes part in the movement of the cover 32. Thus the rotor brake apparatus 5 is also actuated via the switch cam 71 and the transmission lever 6, and the spinning rotor 3 is stopped. Replacement of the spinning rotor, for example, is now possible.

With the aid of the apparatus according to the invention, in spite of the combination of the rotor cleaning apparatus 4 and the rotor brake apparatus, the piecing process is very simply suited to the acceleration process of the spinning rotor 3. This is of great importance. Namely, it has been shown that the high centrifugal forces occurring at high speeds of rotor revolution make piecing difficult, since the piecing region, which always forms a disturbed place in the yarn, easily breaks, so that the spinning rotor 3 has to be cleaned anew and the piecing process must be repeated. For this reason, the present invention postpones rotor cleaning until the phase in which the spinning rotor is braked from production speed to a standstill, while piecing occurs during the acceleration of the spinning rotor 3 to production speed. Since, in this manner, the spinning rotor 3 is stationary after the cleaning process, so that no centrifugal forces act any longer on the components dislodged from the spinning rotor 3, these components are sucked away particularly well via the open rotor edge by the reduced pressure which continues in action.

Without affecting the braking process and the acceleration process of the spinning rotor 3, both rotor cleaning and also piecing can thus be easily accommodated and with the simplest of means.

Figure 3:
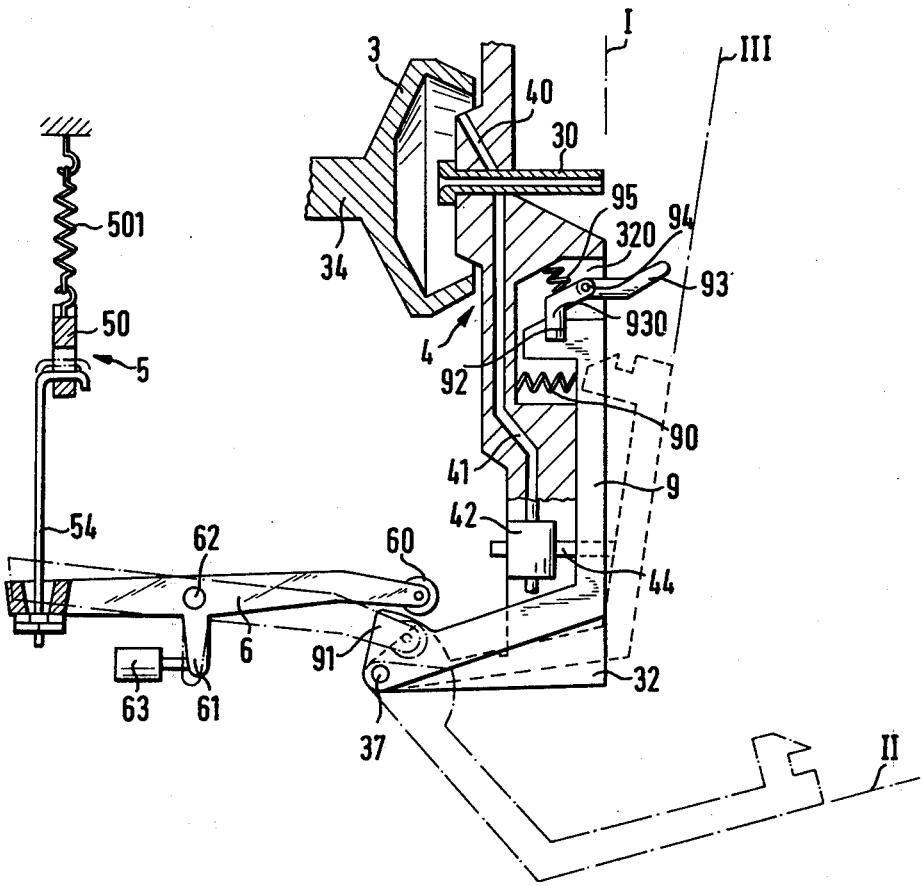
FIG. 3 is a modified form of the invention, in side view and in partial section.

FIG. 3 shows a modification of the object of the invention, with the aid of which a further possibility for the control of the rotor brake apparatus 5 and the rotor cleaning apparatus 4 will be explained. In this embodiment, the control lever 9 can assume three working positions I, II and III. In the first position I, the control lever releases the spinning rotor 3, via the switch cam 91, the transmission lever 6 and the rotor brake apparatus 5; the rotor is thus driven and keeps the rotor cleaning apparatus 4 inoperative, as will be explained later. In the second position II, the control lever 9 is in its other extreme position, in which it is completely pivoted out of the slot 320 of the cover 32. In this position II, the rotor brake apparatus 5 and the rotor cleaning apparatus 4 act on the spinning rotor 3. In the third position III, between positions I and II, the rotor brake apparatus 5 acts on the spinning rotor 3, while the rotor cleaning apparatus 4 is inoperative.

The control lever 9 is acted on by a compression spring 90 which is supported on the cover 32 and which, when the control lever 9 is released, pushes it into the position II. On its end remote from the shaft 37, the control lever 9 further has a recess 92, in which the latch lug 930 of a release lever 93 engages, in position I of the control lever. The release lever 93 is pivotably mounted in the cover 32 by means of a bolt 94 and is acted on by a compression spring 95 supported on the cover 32 and holding the latch lug 930 in engagement with the recess 92. The control lever 9 can thus be locked to the cover 32, so that it is connected to it and moves with it, or else it can be released from the cover 32 and thus be movable relative to it.

In this embodiment, the valve 42 is also attached to the cover 32, and is controlled via an actuating pin 44 which is normally actuated by the control lever 9, but which can be released by movement of the control lever 9 relative to the cover 32 in the region of position II and as far forward as position III of the control lever 9.

If the cover 32 is opened, the control lever 9 also moves with the cover 32, so that the transmission lever 6 is moved via the switch cam 91. The transmission lever 6 is connected via a transmission element 91 to the brake apparatus 5, the brake lever 50 of which, on release by the transmission lever 6 under the action of the tension spring 501, raises the spinning rotor 3 out of the "V" of the support disks 35 and, with the roller 52 (FIG. 4) separates the drive belt 53 from the shaft 34, and presses the latter against the brake block 502. On return of the cover 32 into the closed position, the transmission lever 6 is again pivoted, under the action of the switch cam 91, so that the brake lever 50 also again releases the shaft 34 of the spinning rotor 3. Since the cover 32 moves away from the spinning rotor 3, the rotor cleaning apparatus 4 arranged in the cover 32 does not need to be brought into action.

If, however, the spinning rotor 3 is to be braked, without the cover 32 being raised, as is necessary for a subsequent piecing, only the release lever 93 is actuated, and its latch lug 930 releases the control lever 9. The control lever 9 is brought by the prestressed compression spring 90 from position I into position II. When the control lever is between position I and position II during this movement, its switch cam 91 releases the roller 60 of the transmission lever 6, and the spinning rotor 3 is braked by the rotor brake apparatus 5 which is thus brought into action. If the control lever 9, during its motion, is near position II, the control lever 9 releases the actuating pin 44 so that the valve 42 releases the compressed air supply to the compressed air nozzle 40 of the rotor cleaning apparatus 4. The compression spring 90 can in some circumstances be omitted, since the tension spring 501 acts on the control lever 9 via the pull element 54, the transmission lever 6 and the switch cam 91, in addition to the force of gravity.

The control lever 9 is secured in positions II and III by means of a latching means (not shown) or by a stop.

Thus the cleaning of the spinning rotor 3 occurs as it is braked. Only for reasons of simplifying the apparatus, the valve 42 continues to remain open, until the control lever 9, on initiation of the piecing process, is brought into position III. In this position III, the actuating pin 44 is again actuated, so that the rotor cleaning apparatus 6 (sic) is again inoperative. The spinning rotor 3, is, however, braked as before. As described in connection with FIGS. 1 and 2, the yarn 22 is now introduced into the yarn takeoff tube 30. The control lever 9 is then brought into position I, so that the rotor brake apparatus 5 also again releases the spinning rotor 3. Shortly after pivoting of the control lever 9, the previously raised bobbin arm is again lowered onto its drive roller, so that the yarn 22 is supplied back for piecing in the accelerating spinning rotor 3. By means of the intermediate position III, a particularly simple manner of carrying out the piecing process at a given speed of the acceleration phase is possible.

In order that the operator does not need to control the feed of yarn during piecing, the feed and opening apparatus 1 can be connected in control relation with the control lever 6. According to FIG. 3, the transmission lever 6, which is pivotable about a shaft 62, has for this purpose an arm 61, which cooperates with a switch 63 that in turn, is connected with the electromagnet 16.

The object of the invention can be modified from the embodiments described. Thus for example it is possible to provide a drive element, e.g., an electromagnet, instead of the valve 42, and a mechanical cleaning element instead of the compressed air nozzle 40; the cleaning element is here pushed in a guide and can be temporarily brought into action on the inner wall of the spinning rotor 3.

An embodiment of the invention with a mechanical cleaning element 43 is shown in FIG. 4. The mechanical cleaning element 43 can be designed in various ways, e.g., as a brush or as a scraper. This mechanical cleaning element 43 is guided in a channel 45 and can have its working end brought into contact with the inner surface of the spinning rotor 3. The other end is connected to a drive element. This also can be designed in various ways, for example, as an electromagnet, which is controlled by a switch (not shown) that is controlled by the control lever 7 instead of the valve 42 (see FIG. 3). In the embodiment shown, the drive element is constructed as a two-armed lever 80, which is mounted to pivot about a shaft 81. The mechanical cleaning element 43 is connected to one end of the lever 80; the other end of the lever 80 is connected via a tension spring 46 to the control lever 7.

Also in this embodiment of the invention, the control lever 7 can be locked to the cover 32 or can be released from it. If the control lever 7 is moved with the cover 32, there is no relative movement between the control lever 7 and the lever 80 mounted in the cover 32. Consequently also no movement of the cleaning element 43 takes place, since the insert 36 (see also FIG. 2) covering the spinning rotor 3 is moved with the channel 45, together with the cover 32.

If on the other hand the control lever 7 is moved relative to the cover 32, in order to clean the spinning rotor 3 and thus prepare for a subsequent piecing, the control lever 7 acts via the tension spring 46 on the lever 80, which in turn, displaces the cleaning element into the channel 45 until it finally acts on the inner wall of the spinning rotor 3. Possible path tolerances can be taken up by the tension spring 46.

The control lever 7 can also be brought into three positions in this embodiment which is also an object of the invention; position III can be established so that in fact the rotor brake apparatus 5 remains operative, but not the rotor cleaning apparatus.

As in the embodiments described with reference to FIGS. 3 and 4, the control lever 7 can also, if desired, be brought into the three positions I, II and III according to FIGS. 1 and 2. These three positions of the control lever 7 or 9 make it possible, in a simple manner, for the rotor cleaning apparatus 6 to be operative while the spinning rotor 3 is braked. The piecing is carried out when the rotor brake apparatus 5 has just released the spinning rotor 3, so that it is in the phase of acceleration to the production speed. Piecing of the yarn 22 is effected by introducing an end of the yarn into the yarn takeoff channel 30 during this time, matched to the acceleration process, after return of the control lever 7 or 9 from position III into position I. In this way, both working processes, i.e., both rotor cleaning and also yarn piecing, can be carried out in an optimal way.

It is not absolutely necessary that the control lever 7 or 9 be mounted on the pivot axis 37 of the cover 32. When desired for any reason, its own pivot axis 70 can also be provided, carried by the cover 32.

In the embodiments shown, the control lever 7 or 9 mounted in a slot 320 of the cover 32 is flush with the outer surface of the cover 32. This is particularly advantageous on esthetic grounds, but also for reasons of safety. The invention does not, however, exclude other arrangements and embodiments.

For locking of the control lever 7 or 9 to the cover 32, any suitable apparatus can be utilized. For example, the control lever 7 or 9 can be secured in the positions I and III with the aid of a ball latch (not shown) and in position II by a stop (not shown), and can be furnished for actuation with a handle projecting over the cover 32. Here a separate elastic energy accumulator (e.g., compression spring 90—see FIG. 3) or an elastic energy accumulator, which is simultaneously associated with the rotor brake apparatus 5 (e.g., tension spring 501—see FIGS. 1 and 4) can be provided for the control lever 7 or 9. In this way, it can be considered a possibility for the control lever 7 or 9 to be automatically moved into position II, instead of manually.

The actuation of the release button 73 (See FIGS. 1, 2 and 4) or of the release lever 93 for release of the rotor braking process and rotor cleaning, and also the return of the control lever 7 or 9 into position III and then into position I, also the actuation of the switch button 330, are usually performed by hand, as is the subsequent piecing. It is however also possible for the piecing and the preparatory work mentioned to be carried out automatically with one and the same servicing apparatus, without the possibility of manual initiation and carrying out of these operations being excluded.

What is claimed is:

1. An apparatus for individually piecing-up yarn on an open-end spinning machine, a spinning rotor carried on said machine, a rotor brake provided for stopping said spinning rotor responsive to being activated, a rotor cleaning apparatus for cleaning said rotor responsive to being activated, and a cover pivotally carried on said machine and extending over said rotor for providing access to said rotor, the improvement comprising:

means for supporting said rotor cleaning apparatus on said cover; and a pivotal lever means movable relative to said cover for simultaneously activating said rotor cleaning apparatus and said rotor brake causing said rotor to be cleaned as said rotor is being stopped, said pivotal lever means also being movable together with said cover for only activating said rotor brake causing said rotor to be stopped when said cover is moved to provide access to said rotor.

2. The apparatus as set forth in claim 1 further comprising:

means for selectively positioning said lever means in a first position locked to said cover wherein said lever means via said rotor brake releases said spinning rotor and keeps said rotor cleaning apparatus inoperative;

means for selectively positioning said lever means in a second position wherein said rotor brake and said rotor cleaning apparatus are activated; and means for selectively positioning said lever means in a third position activating said rotor brake and keeping said rotor cleaning apparatus inoperative.

3. The apparatus in accordance with claim 1 or 2 wherein said rotor cleaning apparatus comprises:

(i) at least one compressed air nozzle directed against the interior of said spinning rotor, (ii) switch means carried on said cover operable connected to said compressed air nozzle, and (iii) said lever means operably connected to said switch means for opening said switch means for activating said compressed air nozzle when said lever means is moved relative to said cover.

4. The apparatus as set forth in claim 2 further comprising:

said lever when in said first position being flush with said cover.

5. The apparatus as set forth in claim 2 further comprising:

means for locking said lever means relative to said cover in said first position; and a manipulating element means for disengaging said locking means responsive to be manipulated.

6. The apparatus as set forth in claim 5 further comprising:

means for resiliently biasing said lever means so that when said manipulating element means disengages said locking means said lever means is moved from said first position to said second position.

7. The apparatus as set forth in claim 6 further comprising:

said means for resiliently biasing said lever means is operably connected to said rotor brake apparatus.

8. An apparatus for piecing-up yarn on an open-end spinning machine, a spinning rotor carried by said machine, a rotor brake provided for stopping said rotor responsive to being activated, a pivotal cover extending over said rotor for providing access to said rotor, and a rotor cleaning apparatus carried by said cover, the improvement comprising:

a control member means movable to predetermined first and second and third positions;

means for operably connecting said control member means to said rotor brake and said rotor cleaning apparatus wherein when said control member means is in said first position, both said rotor cleaning apparatus and said rotor brake are inoperative;

said control member means when in said second position activating both said rotor cleaning apparatus and said rotor brake, and said control member means when in a third position activating said rotor brake and maintaining said rotor cleaning apparatus inoperative.

9. The apparatus as set forth in claim 8 further comprising:

said cleaning apparatus including:

(i) a compressed air nozzle directed against an interior of said rotor, (ii) switch means operably connected to said compressed air nozzle for causing compressed air to be supplied to said interior of said rotor when activated, and said control member means being positioned to activate said switch means when said control member means is in said first position and to deactivate said switch means when said control member means is in said second position.

10. The apparatus as set forth in claim 8 or 9 further comprising:

means for supporting said control member means for movement relative to said cover.

11. An apparatus for individually piecing-up yarn on an open-end spinning machine, a spinning rotor carried on said machine, a rotor brake provided for stopping said spinning rotor responsive to being activated, a rotor cleaning apparatus for cleaning said rotor responsive to being activated, and a cover carried on said machine and extending over said rotor and being adapted of being spaced from the latter for providing access to said rotor, the improvement comprising:

said rotor cleaning apparatus being longitudinally fixed to the machine;

a control member means being mounted at a point within the extension of said cover;

said control member means being adapted to be positioned in a first position locked to said cover wherein said control member means via said rotor brake releases said spinning rotor and keeps said rotor cleaning apparatus inoperative;

said control member means being adapted of being moved relative to said cover for simultaneously activating said rotor cleaning apparatus and said rotor brake causing said rotor to be cleaned as said rotor is being stopped while said cover remains in its position where it covers said rotor;

said control member means being furthermore adapted of being moved together with said cover for only activating said rotor brake causing said rotor to be stopped when said cover is moved to provide access to said rotor.

12. The apparatus as set forth in claim 11 further comprising:

said cover is pivotally carried on said machine and said control member is a pivotal lever means adapted to pivot relative to said cover when the latter remains in its closed position and to pivot together with said cover when the latter provides access to said rotor.

13. The apparatus as set forth in claim 12 further comprising:

said pivotal lever means being adapted to take in predetermined second and third positions when being disconnected from said cover;

said lever means when in said second position activating both said cleaning apparatus and said rotor brake and, when being in said third position activating said rotor brake and maintaining said rotor cleaning apparatus inoperative.

14. The apparatus as set forth in claim 12 further comprising:

said pivotal lever means when being locked to said cover being flush with the latter.

15. The apparatus as set forth in claim 12 further comprising:

(I) a compressed air nozzle directed against an interior of said rotor;

(II) an underpressure source mounted at a point of said machine independent of the place where said compressed air nozzle is mounted and being adapted to supply air to a plurality of compressed air nozzles for different rotors;

(III) connection means for connecting said underpressure source with said compressed air nozzle;

(IV) switch means in said connection means for causing compressed air to be supplied by said compressed air nozzle to said interior of said rotor when activated, and said control member means being positioned to activate said switch means when said control member means is moved relative to said cover.

16. The apparatus as set forth in claim 11 further comprising:

means for locking said control member means relative to said cover; and a manipulating element means for disengaging said locking means responsive to be manipulated.

17. The apparatus as set forth in claim 16 further comprising:

means for resiliently biasing said control member means so that when said manipulating element means disengages said locking means said control member means is moved relative to said cover.

18. The apparatus as set forth in claim 17 further comprising:

said means for resiliently biasing said control member means is operably connected to said rotor brake apparatus.

19. An apparatus for individually piecing-up yarn on an open-end spinning machine, a spinning rotor carried on said machine, a rotor brake provided for stopping said spinning rotor responsive to being activated, a rotor cleaning apparatus for cleaning said rotor responsive to being activated, and a cover carried on said machine and extending over said rotor and being adapted of being spaced from the latter for providing access to said rotor, the improvement comprising:

said rotor cleaning apparatus being totally mounted on said machine without any possibility of moving along the machine;

a control member means being mounted at a point within the extension of said cover;

said control member means being adapted of being moved in first, second and third predetermined positions;

said control member means when being in its first position keeps both said rotor cleaning apparatus and said rotor brake inoperative;

said control member means when being operated independent of any movement of said cover taking in its second position in which it activates both said rotor cleaning apparatus and said rotor brake;

said control member means when being operated by relative movement of cover and control member means taking in its third position in which it activates said rotor brake and maintains said rotor cleaning apparatus inoperative.

20. The apparatus as set forth in claim 19 further comprising:

said cleaning apparatus including:

(I) a compressed air nozzle directed against an interior of said rotor;

(II) an underpressure source mounted at a point of said machine independent of the place where said compressed air nozzle is mounted and being adapted to supply air to a plurality of compressed air nozzles for different rotors;

(III) connection means for connecting said underpressure source with said compressed air nozzle;

(IV) switch means in said connection means for causing compressed air to be supplied by said compressed air nozzle to said interior of said rotor when activated, and said control member means being positioned to activate said switch means when said control member means is moved into its third position.

* * * * *